US011180971B2

(12) United States Patent
Craigon et al.

(10) Patent No.: US 11,180,971 B2
(45) Date of Patent: Nov. 23, 2021

(54) FLOW RESTRICTOR

(75) Inventors: Alan Craigon, Angus (GB); Philip C G Egleton, Newmachar (GB); Stephen Reid, Aberdeen (GB); Andrew John Elrick, Peterhead (GB); Santiago Galvez Porta, Peterhead (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 865 days.

(21) Appl. No.: 14/416,909

(22) PCT Filed: Jul. 25, 2012

(86) PCT No.: PCT/GB2012/051788
§ 371 (c)(1),
(2), (4) Date: Aug. 5, 2015

(87) PCT Pub. No.: WO2014/016536
PCT Pub. Date: Jan. 30, 2014

(65) Prior Publication Data

US 2015/0330174 A1 Nov. 19, 2015

(51) Int. Cl.
*E21B 33/126* (2006.01)
*E21B 33/128* (2006.01)
(Continued)

(52) U.S. Cl.
CPC ..... *E21B 33/126* (2013.01); *E21B 23/06* (2013.01); *E21B 33/1208* (2013.01);
(Continued)

(58) Field of Classification Search
CPC ..... E21B 33/00; E21B 33/12; E21B 33/126; E21B 33/136; E21B 33/1208
(Continued)

(56) References Cited

U.S. PATENT DOCUMENTS 2,606,618 A 8/1952 Page
3,097,696 A * 7/1963 Orr ..... E21B 33/1204 166/122
(Continued)

FOREIGN PATENT DOCUMENTS

CA 1272684 A 8/1990
GB 2479085 A 9/2011
(Continued)

OTHER PUBLICATIONS

Examination Report received in corresponding EP Appl. 12751572.4, dated Apr. 3, 2016, 8 pages.
(Continued)

*Primary Examiner* — Robert E Fuller
*Assistant Examiner* — Lamia Quaim
(74) *Attorney, Agent, or Firm* — Blank Rome LLP

(57) ABSTRACT

A flow restrictor for restricting flow in an annulus, the flow restrictor comprising a body and a restrictor assembly mounted on the body, wherein the restrictor assembly is actuatable between a run-in configuration and a set configuration in which at least a portion of the restrictor assembly is radially splayed to thereby substantially restrict flow in the annulus, and wherein the flow restrictor is actuatable by fluid flow over the restrictor assembly above a threshold flow rate to actuate the restrictor assembly from the run-in configuration to the set configuration.

34 Claims, 6 Drawing Sheets

(51) Int. Cl.
*E21B 23/06* (2006.01)
*E21B 43/25* (2006.01)
*E21B 33/12* (2006.01)
*E21B 33/136* (2006.01)

(52) U.S. Cl.
CPC ..... *E21B 33/1285* (2013.01); *E21B 33/136* (2013.01); *E21B 43/25* (2013.01)

(58) Field of Classification Search
USPC ..... 166/202
See application file for complete search history.

(56) References Cited

U.S. PATENT DOCUMENTS 3,369,607 A 2/1968 Turbyfill
3,980,134 A * 9/1976 Amancharla ..... E21B 33/1294 166/133
4,576,042 A * 3/1986 Johnson ..... E21B 47/10 73/152.36
5,261,487 A 11/1993 McLeod et al.
5,396,956 A * 3/1995 Cherewyk ..... E21B 17/1007 166/191
2003/0098153 A1* 5/2003 Serafin ..... E21B 33/126 166/202
2004/0055742 A1* 3/2004 Dallas ..... E21B 17/1007 166/85.3
2006/0219415 A1* 10/2006 Xu ..... E21B 33/1208 166/387
2007/0114019 A1* 5/2007 Brezinski ..... E21B 33/12 166/207
2007/0261863 A1 11/2007 MacLeod et al.
2009/0294128 A1* 12/2009 Dale ..... E21B 43/04 166/306
2010/0126711 A1* 5/2010 Buss ..... E21B 33/126 166/66.7
2011/0108276 A1* 5/2011 Spence ..... E21B 34/063 166/308.1

FOREIGN PATENT DOCUMENTS

WO 2005059304 A1 6/2005
WO 2011037586 A1 3/2011

OTHER PUBLICATIONS

International Search Report received in corresponding PCT/GB2012/051788 dated Mar. 25, 2013, 5 pages.
Notification of Transmittal of International Preliminary Report on Patentability received in corresponding application PCT/GB2012/051788, dated Aug. 18, 2014.

* cited by examiner

SECTION X-X

FLOW RESTRICTOR

The present invention relates to a flow restrictor for restricting fluid flow in an annulus, a method for restricting flow in an annulus, and a method of manufacture of a flow restrictor. Typically, the flow restrictor is used in a wellbore.

Packers are used in downhole applications to seal off an annulus between drilling or production tubing and an open or cased hole. Swell packers are made from elastomers and adapted to swell on contact with downhole fluids. However, the outer surface of swell packers is easily eroded in certain downhole operations.

Other conventional packers can be set downhole by hydraulic or mechanical means into sealing engagement with the hole. Incorporating a hydrostatic or mechanical setting mechanism in a packer increases the number of components and hence overall size of the packer, as well as the complexity of the assembly, thereby increasing the cast.

Accordingly, it is an object of the present invention to provide a solution that alleviates some of the aforementioned disadvantages.

According to a first aspect of the invention, there is provided a flow restrictor for restricting flow in an annulus, the flow restrictor comprising a body and a restrictor assembly mounted on the body, wherein the restrictor assembly is actuable between a run-in configuration and a set configuration in which at least a portion of the restrictor assembly is radially splayed to thereby substantially restrict flow in the annulus, and wherein the flow restrictor is actuable by fluid flow over the restrictor assembly above a threshold flow rate to actuate the restrictor assembly from the run-in configuration to the set configuration.

Thus the invention provides a flow actuable flow restrictor.

Preferably in the set configuration, the flow restrictor can hold a pressure differential within the annulus. In the set configuration, the flow restrictor can hold a pressure of at least 3000 psi (20.7 MPa) in the annulus. In the set configuration, the flow restrictor can hold a pressure of at least 5000 psi (34.5 MPa) in the annulus. In the set configuration, the flow restrictor can hold a pressure of at least 7500 psi (51.7 MPa) in the annulus.

A part of the restrictor assembly can be deformable above the threshold flow rate to move from the run-in configuration to the set configuration. The flow restrictor can plastically deform such that the flow restrictor remains in the set configuration following actuation.

The value of the threshold flow rate can be selected to exceed the flow rates to which the flow restrictor is exposed while the flow restrictor is run-in to a bore. The threshold flow rate over the restrictor assembly can be above 5 barrels per minute.

Selection of the threshold flow rate can be dependent on the anticipated bore size in which the flow restrictor is used. For a given sealing assembly, the value of the threshold flow rate typically increases proportional to the annular area.

The flow restrictor can have a central axis and at least a part of the restrictor assembly can be inclined at an angle relative to the central axis.

Preferably the angle of incline of the flow restrictor relative to the central axis is shallow to reduce the likelihood of premature setting of the flow restrictor.

The angle of incline of the restrictor assembly can be between one and fifteen degrees relative to the central axis.

The angle of incline can be between one and seven degrees relative to the central axis. The angle of incline can be around 3½ degrees relative to the central axis.

The body can be tapered to define the angle of incline of the restrictor assembly mounted on the body. The body can be a mandrel or a tool shaft.

The restrictor assembly can comprise at least one layer of deformable material.

The restrictor assembly can comprise a plurality of layers of deformable material.

At least one layer of deformable material can be a metal.

The at least one deformable layer can have a plurality of petals arranged to radially splay when exposed to fluid flow rates above the threshold value.

The length and thickness of the petals can be selected according to the desired threshold flow rate.

Thus, certain restrictor assembly parameters can be selected according to the anticipated achievable fluid flow rates and viscosity of the fluid used for actuation of the flow restrictor. For example, shorter or thicker petals will require exposure to a higher flow rate or a more viscous fluid at a given flow rate in order to actuate the restrictor assembly.

The petals of material can be arranged to deform in a region proximate the body.

The petals of material can be shaped to deform in a region proximate the body of the flow restrictor. Alternatively, the petals of material can be otherwise mechanically weakened by scoring or reduction in wall thickness such that the petals deform in the region proximate the body.

The restrictor assembly can have at least two interweaved deformable layers.

The interweaved deformable layers can be metal layer.

The deformable layers can comprise a plurality of petals that are interweaved such that radial splay of one petal acts on adjacent petals to urge radial splay of adjacent petals.

The interweaving of the metal layers can be achieved by intermeshing the petals.

The interweaved metal layers can act such that deformation of one part of the metal layer is translated to adjacent parts of the metal layer.

The restrictor assembly can have two deformable layers of petals and the petals can be alternately interweaved with petals from the adjacent layer.

The interweaved metal layers can present a substantially continuous external circumference. The metals layers can present a substantially continuous external circumference in both the run-in and set configurations.

The continuous circumference can be achieved by chamfering edges of the petals of the interweaved metal layer. Alternatively, the thickness of the metal petal can be selected such that the material decreases in thickness towards its edge to provide the continuous external circumference.

The absence of steps in the external circumference of the metal layers is advantageous since, it reduces the risk that fluid flow will act on the step to catch and prematurely set the restrictor assembly.

At least a part of the deformable layer can be provided with a plurality of slots to allow the material of the deformable layer to radially splay.

The slots in the deformable layers can define the petals of material.

The restrictor assembly can comprise a plurality of deformable sealing layers.

A greater number of sealing layers can be incorporated into the flow restrictor to improve the sealing function of the flow restrictor. The sealing layers can be made from rubber or plastic.

The flow restrictor can be actuable by fluid flow over at least a portion of an outer surface of the restrictor assembly. The outer surface of the restrictor assembly can be exposed to fluid flow in the annulus. The flow restrictor can be actuable by fluid flow over an outer surface of the at least one deformable layer. The flow restrictor can be actuable by fluid flow above the threshold value over an outer surface of the petals of the restrictor assembly.

Frictional drag effects caused by the fluid flow over an outer exposed surface of the flow restrictor can initiate radial deformation of the restrictor assembly and splay into the annulus.

The fluid used for actuation of the flow restrictor can be flowed along the annulus between the flow restrictor and the open or cased hole. Fluid can be pumped or otherwise circulated in the annulus. Fluid can be directly pumped into the annulus or pumped within the throughbore and communicated to the annulus via a plurality of polls. Alternatively, the flow restrictor can be configured to set in response to downhole fluid flow, for example, such as fluid flow rates anticipated when a well is brought on (i.e. hydrocarbons are produced).

The flow restrictor can have a fixed portion that remains fixed relative to the body in both the run-in and set configurations, and a movable portion that is movable from a stowed position in the run-in configuration to a radially splayed position in the set configuration, in response to fluid flow over at least a portion of the restrictor assembly above a threshold rate and flowing in a direction from the movable portion towards the fixed portion.

The movable portion and the fixed portion can be separated by a deformable portion.

Fluid can be flowed above the threshold rate in a direction from the radially outermost to the radially innermost deformable part of the restrictor assembly to actuate the flow restrictor. Fluid above the threshold flow rate can be flowed across at least a part of the restrictor assembly relative to the central axis to actuate the flow restrictor.

The flow restrictor can also comprise a backup mechanism to restrict further deformation of the flow restrictor once the flow restrictor is in the set configuration.

The backup mechanism can be a mechanical backup and can substantially retain the restrictor assembly in the set configuration. Thus, the backup mechanism can impart mechanical strength to the flow restrictor to limit further deformation when the flow restrictor is in the set configuration and holding a pressure differential within the annulus.

The backup mechanism can be arranged such that movement of the restrictor assembly to the set configuration actuates the backup mechanism.

The backup mechanism can support at least a portion of the length of the restrictor assembly and restricts further movement of the restrictor assembly in the direction of fluid flow.

The backup mechanism can also include a lock. The lock can be arranged to lock the backup mechanism in the set configuration.

The flow restrictor can be arranged to act as an annular seal in the set configuration. Thus, the flow restrictor can function as a typical packer. A maximum permissible leak rate can be selected for the flow restrictor in the set configuration to enable the flow restrictor to hold pressure with some small allowable fluid transfer across the flow restrictor.

The flow restrictor can be arranged to act as a fluid flow diverter within the annulus.

The flow restrictor can be arranged to act as an actuator. The flow restrictor can be mounted on a tubular proximate a tool such that the flow restrictor is slidable along the tubular when a predetermined flow rate acts against the flow restrictor in the set configuration to thereby act as an annular piston and actuate the tool.

The flow restrictor can be arranged for downhole applications as a downhole flow restrictor. The flow restrictor can be arranged to restrict flow in a downhole annulus, for example an annulus between an open hole and a tubing string or an annulus between a cased hole and a tubing string.

According to a second aspect of the invention, there is also provided a method of restricting flow in an annulus, the method comprising the steps of:

- providing a flow restrictor comprising a body and a restrictor assembly mounted on the body;
- running the flow restrictor into a hole in a run-in configuration;
- pumping fluid into the hole above a threshold rate;
- flow actuating the flaw restrictor from the run-in configuration to a set configuration in which at least a portion of the restrictor assembly is radially splayed, by flowing fluid over the restrictor assembly above the threshold flow rate; and
- thereby substantially restricting flow in the annulus.

The method can include fixing a portion of the restrictor assembly relative to the body and providing a movable portion of the restrictor assembly above the threshold flow rate in a direction from the movable portion towards the fixed portion causes radial splaying of the movable portion.

The method can include separating the fixed portion from the movable portion by providing a deformable therebetween such that radial splay of the movable portion can be facilitated by deformation of the deformable portion.

The method can include pumping fluid above the threshold flow rate into an annulus between the hole and a tubing. The method can include pumping fluid above the threshold flow rate into an annulus by pumping fluid through tubing having a port opening into the annulus.

The method can include arranging a flow restrictor on each side of the port in opposing relation adjacent the port. Thus as fluid exits the port and travels through the annulus in opposing directions on each side of the port, the opposing arrangement of the flow restrictors can seal the annulus on either side of the port.

The method can include arranging the flow restrictors as close as possible to the port. The method can include locating the flow restrictors within one meter of the port opening into the annulus.

The method can include moving the flow restrictor from the run-in configuration to the set configuration by deforming the restrictor assembly in response to fluid flow above the threshold flow rate.

The method can include providing a plurality of metal petals in the restrictor assembly and deforming the petals by flowing fluid over the restrictor assembly above the threshold value.

The method can include selecting the value of threshold flow rate such that it exceeds flow rates to which the flow restrictor is exposed during running the flow restrictor into the hole.

The method can include inclining at least a portion of the restrictor assembly relative to the body.

The method can include providing a backup mechanism to substantially restrict further deformation of the flow restrictor once the flow restrictor is in the set configuration and activating the backup mechanism by moving the restrictor assembly from the run-in to the set configuration.

The method can include sealingly engaging the hole when the flow restrictor is in the set configuration. The method can include maintaining a pressure differential within the annulus when the flow restrictor is in the set configuration.

The method can include restricting flow in an open borehole. Alternatively, the method can include restricting flow in a hole lined with tubing such as casing. The method can include forming a metal-to-metal seal with an interior of the casing in the set configuration.

There is also provided a method of stimulating a geological formation including the steps of:

opening a port in a tubing;

restricting flow in an annulus according the method of the second aspect of the invention, including pumping stimulating fluid above the threshold flow rate; and stimulating the geological formation using the flow restrictor in the set configuration to substantially obturate the annulus and direct the flow of stimulating fluid into the geological formation.

The method of stimulating a geological formation can be a method of fracturing a formation, such as a shale formation for the extraction of hydrocarbons therefrom.

Embodiments of the first aspect of the invention are also applicable to the second aspect of the invention, where appropriate.

According to a third aspect of the invention, there is also provided a method of manufacturing a flow restrictor comprising the steps of:

(i) casting a substantially cylindrical shape to form a body;

(ii) forming at least one deformable layer; and (iii) coupling a portion of the at least one deformable layer to the body to thereby form the flow restrictor such that at least a portion of the deformable layer is arranged to radially splay in response to fluid flow over the deformable layer above a threshold rate. Step (ii) can include cutting at least one deformable layer by cutting a shape from sheet material.

Step (ii) can comprise cutting a deformable layer from a sheet of metal. Cutting the sheet metal can include stamping the layer from the sheet. Alternatively, the sheet metal layer can be laser cut or water cut.

Step (ii) can comprise cutting a deformable layer from a polymer film. Cutting the polymer film can include the step of punching or pressing the deformable layer from the polymer sheet.

Cutting the at least one deformable layer can include the step of cutting an arcuate-shaped layer such that when coupled to the body, the deformable layer forms a frustoconical shape therearound.

The method can include the step of cutting slits in the at least one deformable layer such that the arcuate layer has a collar portion for coupling to the body and a deformable slit portion.

Alternatively or additionally, step (ii) can include casting the deformable layer.

Step (ii) can include casting a deformable layer having a slitted portion.

Step (iii) can include coupling the at least one deformable layer to the body by welding. Step (iii) can include coupling the at least one deformable layer to the body by nesting the at least one deformable layer thereagainst. Step (iii) can include coupling the at least one deformable layer to the body using adhesive.

The method can further include the steps of:

(iv) casting a substantially cylindrical backup; and (v) joining the backup to the body such that the at least one deformable layer is at least partially located between the body and the backup.

Step (iv) can include casting a backup having a cylindrical collar and slits.

Prior to step (v) there can be a step of assembling the backup such that the slits of the backup and the slits of the at least one deformable layer are not aligned.

Step (v) can include joining the backup to the body using a joining means such that the joining means give a visual indication of correct assembly.

The above described method of manufacture provides a method of manufacturing a flow actuated flow restrictor.

According to a fourth aspect of the invention, there is also provided a flow restrictor for restricting flow in an annulus, the flow restrictor comprising a restrictor assembly actuable between a run in configuration and a set configuration in which at least a portion of the restrictor assembly is splayed to thereby substantially restrict flow in an annulus, and wherein the restrictor assembly has at least two layers of interweaved elongate elements deformable to move between the run-in and set configurations.

The at least two layers of elongate elements can be interweaved such that radial splay of one elongate element acts on adjacent elongate elements to urge radial splay of adjacent elongate elements.

The restrictor assembly can have two layers of elongate elements and the elongate elements from a first layer are alternately interweaved with elongate elements from a second layer.

A leading edge of each elongate element can overlay a trailing edge of an adjacent elongate element on one side, and a trailing edge of each elongate element can be overlaid by a leading edge of an adjacent elongate element on the other side.

The elongate elements can be metal elongate elements.

Deformation of elongate elements can be actuable by fluid flow above a threshold flow rate. Alternatively, deformation of elongate elements can be actuable by a mechanical mechanism.

The elongate elements can comprise petals extending outwardly from a collar.

The flow restrictor of the fourth aspect of the invention can comprise a restrictor assembly having one or more common components of the restrictor assembly described with reference to the first aspect of the invention. The restrictor assembly of the fourth aspect of the invention can be manufactured in a substantially similar manner as described with reference to the third aspect of the invention.

The flow restrictor can be a downhole annular sealing system, such as a packer.

Embodiments of the first, second and third aspects of the invention are also applicable to the fourth aspect of the invention where appropriate.

Embodiments of the invention will now be described with reference to and as shown in the accompanying drawings in which.

Figure 1:
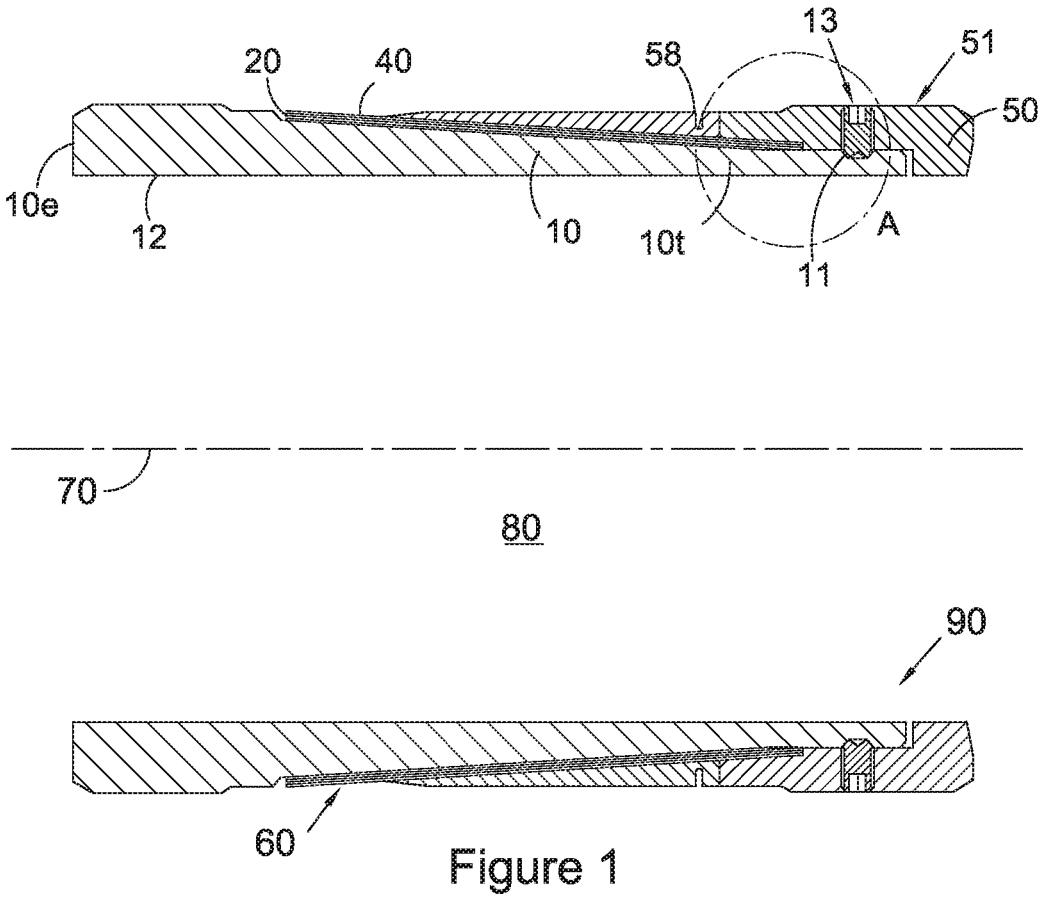
FIG. 1 is a sectional view of a flow restrictor according to a first embodiment of the invention.
Figure 2:
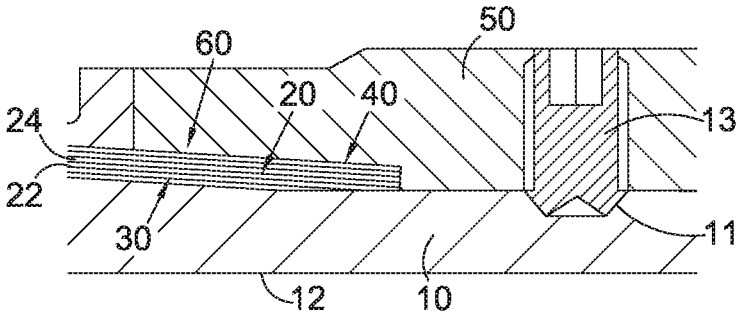
FIG. 2 is a detailed sectional view of portion A of FIG. 1.

A downhole flow restrictor according to a first embodiment of the invention is shown in the form of a packer 90. FIG. 1 shows the packer 90 in a run-in configuration. The packer 90 is generally cylindrical, defining a central axis 70 and having a throughbore 80. The packer 90 is made up from several components: a mandrel 10; a restrictor assembly in the form of a swabbing assembly 60; and a seal backup 50, each of these components being arranged coaxially around the central axis 70 of the packer 90.

The mandrel 10 is provided as a body or shaft for the flow restrictor and is tapered towards one end lot at an angle of taper of 3.4 degrees. At an opposing end, the mandrel 10 has an end face 10*e* perpendicular to the central axis 70. A cylindrical inner surface 12 of the mandrel 10 surrounds the throughbore 80 and enables the mandrel 10 to be slotted onto another tubular (not shown) as part of a tubing string.

Towards the tapered end 10*t*, an outer surface of the mandrel 10 has a cylindrical annular groove 11 formed therein, for receiving an end of a set screw 13 that secures the swabbing assembly 60 to the mandrel 10.

The swabbing assembly 60 has an inner PEEK layer 30, an inner layer 22 of metal petals intermeshed with an outer layer 24 of metal petals and a rubber layer 40 that overlays the outer layer 24 of metal petals.

Figure 3:
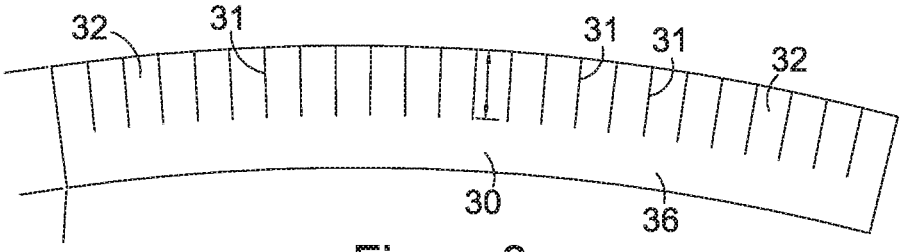
FIG. 3 is a plan view of a plastic layer of the flow restrictor of FIG. 1 prior to assembly.

The PEEK layer 30 is shown prior to incorporation into the swabbing assembly 60 in FIG. 3. The PEEK layer 30 is cut in an arcuate or windscreen shape such that it adopts a frustoconical shape when rolled and incorporated into the swabbing assembly 60. The PEEK layer 30 has a collar 36 and a slit portion having a series of axial slits 31 cut therein at regular intervals to define a plurality of petals 32.

Figure 4:
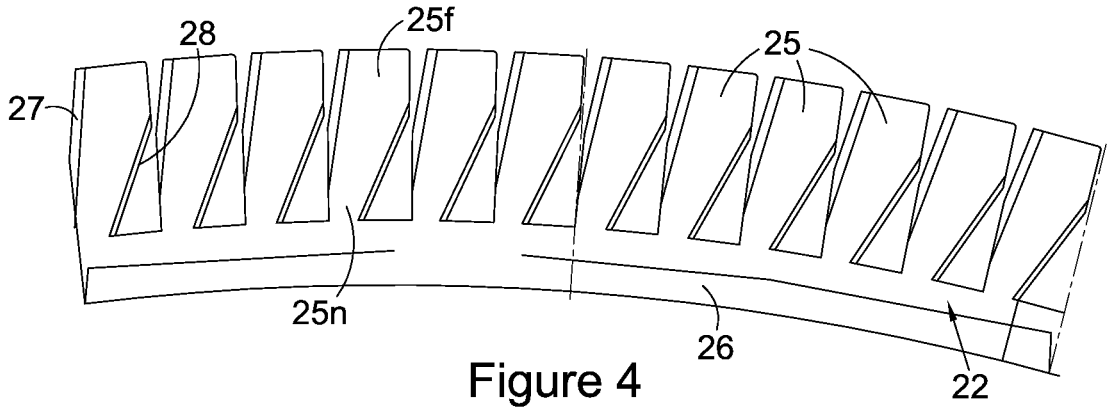
FIG. 4 is a plan view of a metal layer of FIG. 1 prior to assembly.

FIG. 4 shows the inner layer 22 of metal petals prior to incorporation into the swabbing assembly 60. The layer is formed from a steel such as Corten A. The layer consists of an arcuate or windscreen shaped collar 26 with a plurality of metal petals 25 extending therefrom. Each metal petal 25 has a narrow end 25*n* towards the interface with the collar 26 and a flared end 25*f* distal from the collar 26. The geometry of each petal 25 ensures that deformation of the petal 25 occurs preferentially towards the narrow end 25*n* where the petal 25 has the least material in the region of the interface between the petal 25 and the collar 26. The geometry of the petals 25 also facilitates intermeshing with petals from the outer metal layer 24. Each petal 25 has a chamfered trailing edge 28 and a chamfered leading edge 27. Each petal 25 also has chamfered leading and trailing edges (not shown) on the opposing side of the layer 25 shown in FIG. 4.

The outer layer 24 of metal petals is substantially similar to those shown in FIG. 4. However the radius of curvature of the outer layer 24 collar is lower to account for the slightly wider diameter of the assembled outer layer 24. Additionally the outer layer 24 is longer to account for the increased circumference.

The rubber layer 40 is similar in plan view to the PEEK layer 30 also having a collar and a similar slit portion extending therefrom to create a plurality of petals.

The length and thickness of the metal petals 25 of each layer 22, 24 are selected according to the threshold fluid flow rate above which it is desired to set the packer 90. The specific threshold flow rate is dependent on the downhole application. Factors taken into account include the anticipated flow rates achievable downhole to set the packer 90, the viscosity and specific gravity (density) of the fluid to which the swabbing assembly 60 will be exposed and the width of the annular space to be sealed. The 'normal' flow conditions within the well to which the undeployed packer 90 will be subject when run downhole, as well as operational flow conditions in the annulus are usually selected to be below the threshold value. Thus the packer 90 can be arranged to set only at high fluid flow rates and the design of the swabbing assembly 60 can be varied to take this into account. If it is desired to set the packer at a high flow rate or in a wider annular space, the petals 25 can be modified by increasing their length or reducing their thickness.

According to the present embodiment, the length and thickness of the metal petals 25 have been selected such that the threshold value above which the swabbing assembly 60 will be actuated is 7 barrels per minute within the anticipated hole size of 6 inches (0.15 metre).

Figure 5:
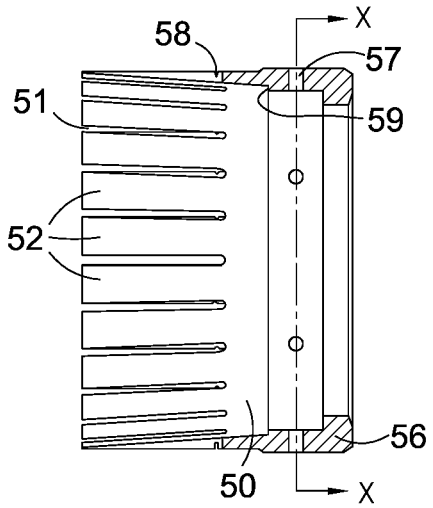
FIG. 5 is a sectional view of a backup mechanism of FIG. 1.
Figure 6:
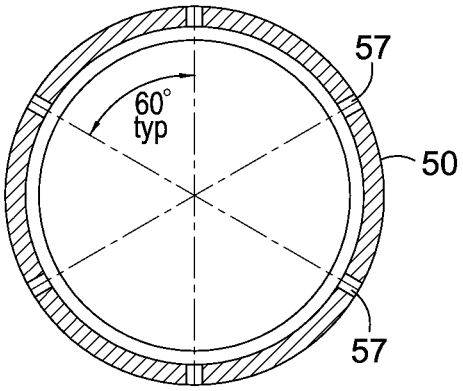
FIG. 6 is a view on Section B-B of FIG. 5.

The seal backup 50 is shown in FIG. 5 and is generally cylindrical made from AISI 4140 (18 HRc min). The seal backup 50 has a collar 56 having an inner diameter matching that of the inner surface 12 of the mandrel 10. The collar 56 of the seal backup 50 has six radially spaced holes 57 extending therethrough (shown in FIG. 6). Each hole 57 is adapted to receive a set screw 13. The collar 56 is provided with an annular shoulder 59, the depth of which is calculated to match the thickness of the assembled swabbing assembly 60. U-shaped axially extending slits 51 extend from the collar 56 to create a plurality of metal fingers 52 having a thickness that decreases along their length from the collar 56 towards the opposing end. A V-shaped annular notch 58 is formed around an outer surface of the seal backup 50 and is located in the region of the base of the fingers 52.

The method of manufacture of the packer 90 will now be described. The manufacturing method is devised in order to minimise the overall number of method steps using relatively low cost, mass production techniques.

The mandrel 10 can be cast in a mould from steel or S.G. iron. The seal backup 50 is cast in a mould and post-machined from a low alloy steel such as AISI 4140 (18 HRc min). The external profile and surface features are preferably formed as part of the casting process. Thus the mandrel 10 and seal backup 50 are cast with no or minimum post-machining. Alternatively, the groove 11 in the outer surface of the mandrel 10 and the V-shaped notch 58 can be turned or machined into the seal backup 50. Six holes 57 are then drilled through the collar 56 of the seal backup 50.

The inner layer 22 and outer layer 24 of metal petals 25 are stamped out of a layer of sheet metal having a thickness of around 0.0625 in (1.5 mm). As part of the stamping process, the leading and trailing edges of the petals 25 are crunched to create the chamfered edges 27, 28. An alternative to stamping is cutting the layers 22, 24, such as laser cutting or water cutting. A separate grinding step could be used to create the chamfered edges. However, stamping and crunching are preferred as the lower cost options.

The PEEK inner layer 30 and outer rubber layer 40 are pressed out or stamped from sheeting.

Once the individual components have been manufactured they are assembled as follows. The collars 26 of the inner layer 22 and the outer layer 24 are aligned and the petals 25 of the adjacent layers 22, 24 are intermeshed. FIGS. 13 to 16 show the intermeshing of the petals 25. The leading edge 27 of one petal 25 overlays the trailing edge 28 of the adjacent petal from the adjacent layer. The petals 25 of the metal layers 22, 24 are intermeshed, rolled and welded together.

An outside surface of the collar of the rubber layer 40 is bonded using adhesive to the inner surface of the collar 56 of the seal backup 50. The inner PEEK layer 30 is similarly bonded to an inside surface of the collar 26 of the inner metal layer 22. The inner and outer metal layers 22, 24 are then aligned with and placed within the outer rubber layer 40, so that the gaps between adjacent metal petals 25 in the region of the collar 26 are covered by the rubber layer 40, now attached to the seal backup 50. An end face of the collars 26 abuts the annular shoulder 59 of the seal backup 50 and the swabbing assembly 60 nests between the mandrel 10 and the seal backup 50.

The mandrel 10 is slotted within the swabbing assembly 60 with the tapered end 10*t* located towards the collar 56 of the seal backup 50. The swabbing assembly 60 is presented at a shallow angle of 3.4 degrees relative to the central axis 70 (and the anticipated direction of fluid flow) by the arrangement of the swabbing assembly 60 over the tapered end 10*e* of the mandrel 10. The angled presentation of the swabbing assembly 60 is enabled as a result of the slits 31 in the layers. The swabbing assembly 60 is positioned so that the metal petals 25 in the outer layer 24 are not aligned with the slits 51 of the seal backup 50.

Therefore, each slit 51 in the seal backup 50 faces a central portion of a petal in the outer rubber layer 40 to improve the overall sealing function of the packer 90.

The groove 11 in the outer surface of the mandrel 10 is aligned with the holes 57 in the seal backup 50. Set screws 13 are then inserted through each of the holes 57 to connect the seal backup 50 to the mandrel 10 as shown in FIG. 1. The length of each hole 57 combined with the depth of the groove 11 is calculated to equal the length of the set screw 13. As a result, once the set screws 13 are inserted, the head of each screw 13 is flush with the outer surface of the seal backup 50. This provides a useful visual indication of correct packer 90 assembly.

Figure 7:
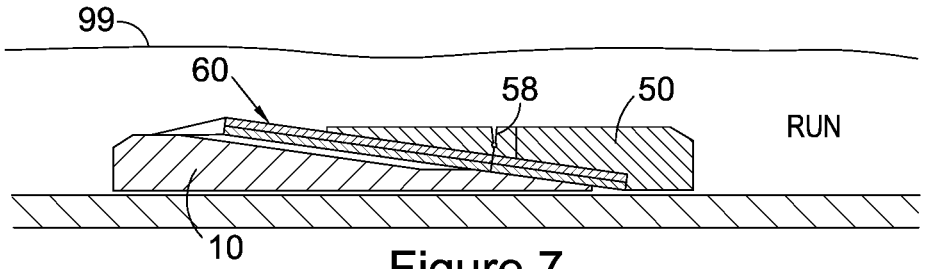
FIG. 7 is a partial sectional schematic view of the flow restrictor in a run-in configuration.

Once the packer 90 has been correctly assembled, it occupies the relatively compact run-in configuration shown in FIG. 1 (or schematically in FIG. 7).

The packer 90 is slotted over a pin end of a tubing (not shown) with the inner surface 12 of the packer 90 slidable along the outer surface of the tubing until the packer abuts a coupling at the opposing end. A lock ring (not shown) is similarly slid over the tubing until the lock ring abuts the packer 90. The lock ring can be attached to the outer surface of the tubing so that the packer 90 is retained in position sandwiched between the end coupling and the lock ring. Alternatively, the mandrel 10 could be secured to the tubing by securing means, such as grub screws (not shown).

The tubing is then connected into a tubing string (not shown). In this run-in configuration, the swabbing assembly 60 does not protrude significantly beyond an outer diameter (gauge diameter) of the packer 90, facilitating the running-in of the packer 90 with the tubing string and reducing the chances that the packer 90 will be prematurely set. During run-in, fluid flow over the packer 90 in the direction of arrow C will not affect the packer 90, which will remain in its run-in configuration until the flow exceeds the predetermined threshold value. The tubing string is run downhole and the packer 90 is located in the required downhole position where it is desired to substantially seal an annulus between the exterior of the tubing string and an open hole 99. According to the present embodiment, the diameter of the open hole 99 in which the tubing string is located is approximately 6 inches (0.15 meter).

When it is desired to set the packer 90, high pressure fluid is pumped down the annulus at a flow rate higher than the threshold value of around seven barrels per minute. The fluid flows over the petals in the direction of arrow C, from the free end of the swabbing assembly 60 towards the end that is fixed to the collar 56 of the seal backup 50. Once flow rates of fluid past the packer 90 exceeds the threshold, the packer 90 will be actuated. Initially fluid flow over the packer 90 causes a frictional drag over the petals 25 in the outer layer 24. The frictional effect of a sufficiently high rate of fluid flow above the threshold drags the petals 25 outwardly in the direction of flow. Since the petals 25 are constrained at the collar 26, the outer end of the petals 25 splay into the annulus. Once there is a certain degree of lift applied to the petals 25, a portion of the fluid in the direction of arrow C flows beneath the underside of the petals 25 and further urges them radially outwardly until the petals 25 encounter the inside surface of the borehole 99.

The intermeshing of petals 25 of the inner and outer metal layers 22, 24 has the advantage that once the flow catches one petal 25 and it begins to 'swab' or move radially outwardly, the adjacent petals 25 are dragged along with the swabbing petal 25. The chamfered edges 27, 28 on the petals 25 give a continuous outer circumference (shown in FIG. 16) to reduce the risk that high fluid flow rates will catch the underside of an individual petal 25 and cause uneven deformation.

Figure 8:
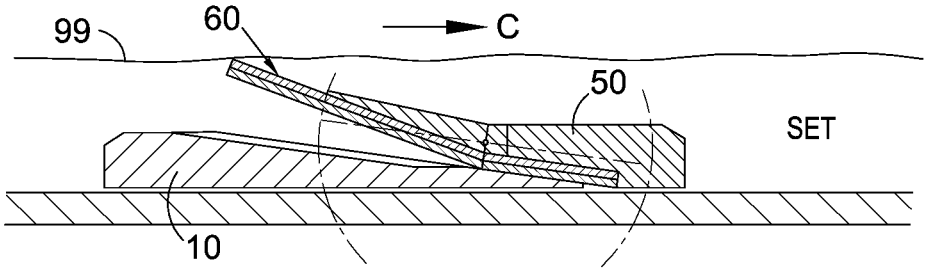
FIG. 8 is a partial sectional schematic view of the flow restrictor of FIG. 7 in a set configuration.

The high fluid flow rates energise the petals 25 to urge them outwardly, which in turn forces the petals 51 of the seal backup 50 to splay in the radial direction as shown in FIG. 8. The seal backup 50 deforms in the region with the lowest material thickness at the V-shaped notch 58. Further radial splay of the swabbing assembly 80 acts on the seal backup 50 to splay the petals 51. The notch 58 in the outer surface closes to resist further deformation of the seal backup 50. The seal backup 50 then functions to give the set packer 90 mechanical strength and resistance to further deformation that would compromise the sealing ability of the packer 90. The petals 51 of the seal backup 50 support the petals 25 of the swabbing assembly 60 along at least a part of their length to prevent the petals 25 from being deformed out of shape.

Once all the metal petals 25 have deformed such that their outer edge is engaged with, the borehole 99 and once the seal backup 50 has deployed, the packer 90 can restrict fluid flow and hold pressure within the annulus. Pressure monitoring at the surface of the well provides an indication that the packer 90 has successfully set by registering a peak in pressure.

This occurs once the annulus is sealed or 'swabbed' and further fluid flow past the packer 90 is restricted by the outwardly splayed petals 25.

The packer 90 has the further advantage that it can provide an annular seal within any borehole 99 shape since the petals 25 continue to splay radially until they anchor against the wall of the borehole 99. Thus no centralisation is required for actuation or setting of the packer 90 to seal against the borehole 99 wall.

The properties of the packer 90 may be modified according to the downhole conditions and expected flow rates to control when it will deploy in the annulus.

For example, selecting a greater sheet metal thickness from which the metal inner and outer layers 22, 24 are manufactured will require an increased flow rate in order to set the packer 90. If the fluid flowing over the swabbing assembly 60 has a high viscosity, the frictional drag of fluid over the petals 25 will increase, with the result that the petals 25 will splay at a lower flow rate when compared with a less viscous fluid. Length of the metal petals 25 can also be selected to vary the conditions in which the packer 90 will be set. Although the steel, Corten A was used in the present embodiment, alternative materials having a high yield strength can be used to manufacture the metal petal layers 22, 24. As an alternative, the V-shaped notch 58 of the seal backup 50 can differ in shape. For example a U-shaped notch may be easier to form in the external surface of the seal backup 50.

The size of the annulus required to be sealed also affects the threshold flow rates. For example, the same packer 90 placed within a borehole having a larger diameter (and hence a larger annular area for a given tubing size) than the first embodiment of 6¼ inches (0.165 metres) requires a greater flow rate to cause actuation of the packer 90. In this case the threshold flow rate can be 20 barrels per minute.

Typically, conventional packers are required to be carried on a separate sub, which takes up space in the tubing string and spaces the packer from adjacent tools. The packer 90 of the invention is sufficiently compact that it can be slotted over standard API 5CT tubing allowing the packer 90 to seal the annulus as close as possible to the area of interest. For example, a so-called 'fracturing' operation involves the injection of high pressure fracturing fluids through ports in the tubing string to fracture geological formations. Set packers located either side of the ports divert the fracturing fluids towards the formation. Conventional packers are added on an adjacent sub to seal the annulus several metres away from the ports. However, the packer 90 of the present invention can be inserted onto the sleeve valve sub (not shown) enabling the annulus to be sealed immediately adjacent the open ports such that all the high pressure fluid exiting the ports is directed towards a narrower surface area of the formation, thereby increasing the penetration and effectiveness of the fracturing operation.

Thus the flow restrictor of the first embodiment of the invention acts as a packer 90 to substantially seal the annulus.

The method of manufacture involves use of low cost bulk production techniques.

The low number of components to be assembled results in a relatively inexpensive and easy to manufacture packer 90. The fact that the flow restrictor has few parts results in numerous advantages such as reduced cost, a compact structure, increased reliability and ease of visual inspection.

The flow restrictor is advantageous since it can be used to retrofit existing tubing.

Although, if required for a specific application, the flow restrictor in the form of the packer 90 can be mounted on its own sub having standard end connections for coupling the packer within a tubing string.

According to a second embodiment, a flow restrictor is manufactured and constructed as described for the packer 90 of the first embodiment (with like reference numerals), however, the flaw restrictor is also arranged to perform the secondary function of actuating a tool.

The flow restrictor of the second embodiment is slidably mounted on a sub (not shown) until one end abuts a connector. The flow restrictor is attached to the exterior of the tubing using some shear screws. A tool requiring downhole mechanical actuation (such as a sliding sleeve) is also located on the sub downstream relative to the direction of fluid flow for setting the flow restrictor.

The flow restrictor is run downhole and actuated by fluid flow above the threshold value as previously described. Once the outer ends of the petals 25 engage the borehole 99, continued high rates of fluid flow act on the petals 25 and the shear screws shear at a predetermined force. The flow restrictor is no longer attached to the sub and it slides therealong towards the sleeve, acting as an annular piston. An end face of the seal backup 50 then contacts the sleeve to mechanically actuate the sleeve valve. Thus the flow restrictor of the second embodiment is set to cause a flow restriction and thereby create a downhole piston area for actuating other tools.

As an alternative, a flow restrictor constructed and made as described for the first embodiment of the invention, can act as a flow diverter.

According to alternative embodiments, the swabbing assembly 60 of the flow restrictor can be modified according to the specific downhole application.

PEEK was selected for the inner layer 30 of the described embodiments due to its superior properties as a thermally stable thermoplastic. However, the PEEK layer 30 can be omitted or substituted for an alternative plastic layer or a rubber layer. Alternatively, where a fluid tight seal is important for a particular application, additional swabbing layers can be incorporated into the assembly 60, such as further rubber layers 40, which enhance the sealing capability. The number and form of the metal petal layers 22, 24 can also be varied.

Figure 9:
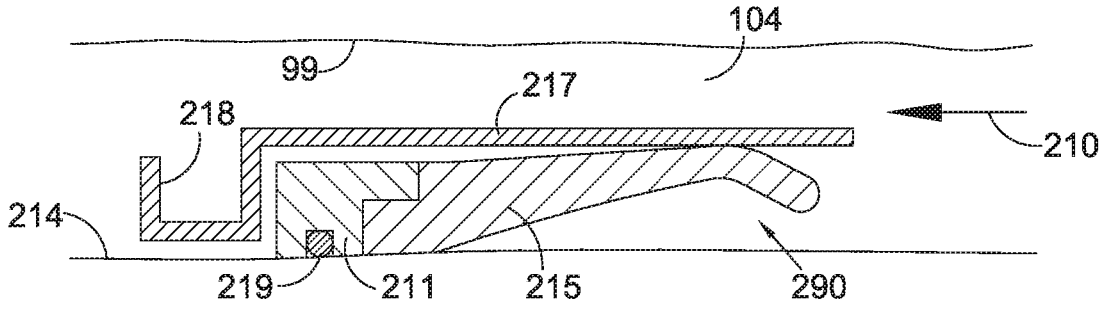
FIG. 9 is a partial sectional schematic view of a flow restrictor according to a second embodiment of the invention in a run-in configuration.
Figure 10:
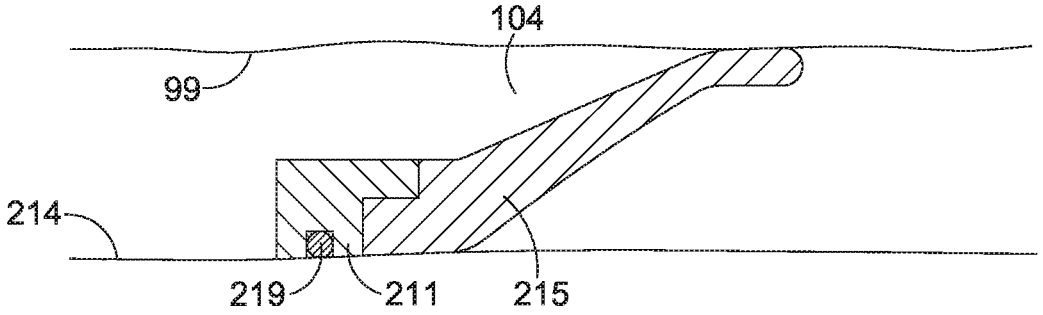
FIG. 10 is a partial sectional schematic view of the flow restrictor of FIG. 9 in a set configuration.

FIG. 9 shows an alternative flow restrictor 290 in a run-in configuration. The flow restrictor 290 has a metal collar 211 sealed against an outer surface 214 of tubing by means of an annular seal 219. The metal collar 211 has a rubber cup 215 bonded thereto. The rubber cup 215 is shaped to radially splay to substantially obturate an annulus 104 defined between the outer surface 214 of the tubing and the borehole 99. In the run-in configuration a plastic cylindrical sheath 217 is placed over the flow restrictor 290 to deform the rubber cup 215 such that the cup 215 is retained proximate the outer surface 214 of the tubing and prevented from radially splaying to fill the annulus 104. The sheath 217 is frictionally retained over the flow restrictor 290 and is provided with a lip 218 for catching fluid flow. The threshold flow rate, is selected as 5 barrels per minute above which the flow restrictor 290 of FIGS. 9 and 10 is actuable.

As the flow restrictor 290 is run downhole, flow of fluids passing thereover is typically less than 5 barrels per minute and therefore the flow restrictor 290 remains in the run-in configuration. The flow restrictor 290 is positioned down hole in the required position where it is desired to seal against the borehole 99. Fluid flow is then pumped downhole at a rate higher than five barrels per minute. Fluid flows along the annulus 104 in the direction of an arrow 210, from the free end of the rubber cup 215 towards the end that is fixed to the collar 211.

Once flow rates over the flow restrictor exceed the threshold of five barrels per minute, force applied to the lip 218 by flow above the threshold rate overcomes the frictional force retaining the sheath 217 against the flow restrictor 290. The sheath 217 is forced off the flow restrictor 218 and the cup 215 is no longer constrained as shown in FIG. 10. Flow catches the underside of the cup 215 and urges the cup 215 to radially splay within the annulus 104 into the set configuration to thereby seal the annulus 104.

Figure 11:
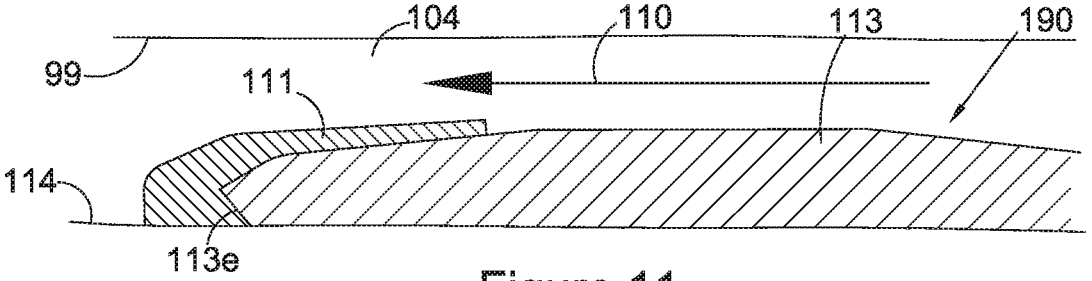
FIG. 11 is a partial sectional schematic view of a flow restrictor according to a third embodiment of the invention in a run-in configuration.

FIG. 11 shows an alternative embodiment of a flow restrictor 190 in a run-in configuration. The flow restrictor 190 has a metal collar 111 attached to an outer surface 114 of a tubing. The collar 111 is adhesively bonded to a block of elastomeric material 113 at one end 113*e*. This retains the elastomeric material 113 against the outer surface 114 of the tubing, such that the elastomeric material 113 does not splay into the annulus 104. The threshold fluid flow rate for the flow restrictor is selected to be above 6 barrels per minute.

Figure 12:
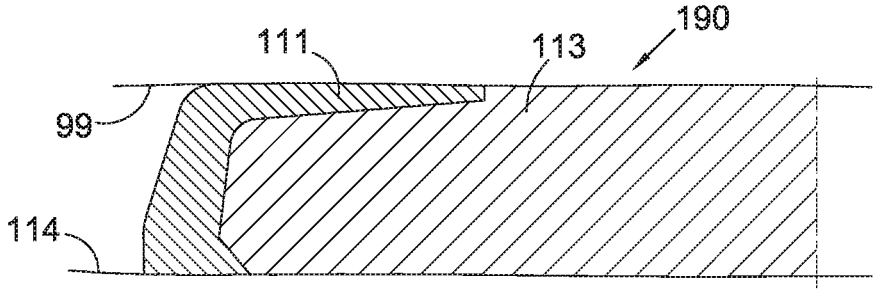
FIG. 12 is a partial sectional schematic view of the flow restrictor of FIG. 11 in a set configuration.
Figure 13:
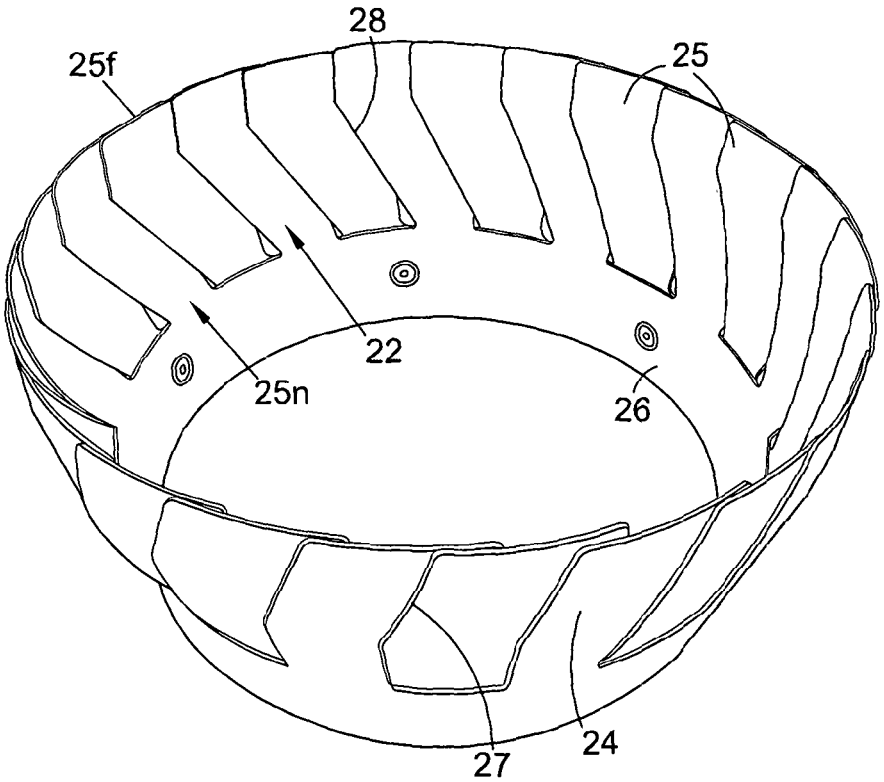
FIG. 13 is a perspective view of two layers of rolled intermeshed petals of prior to insertion into the flow restrictor of FIG. 1.
Figure 14:
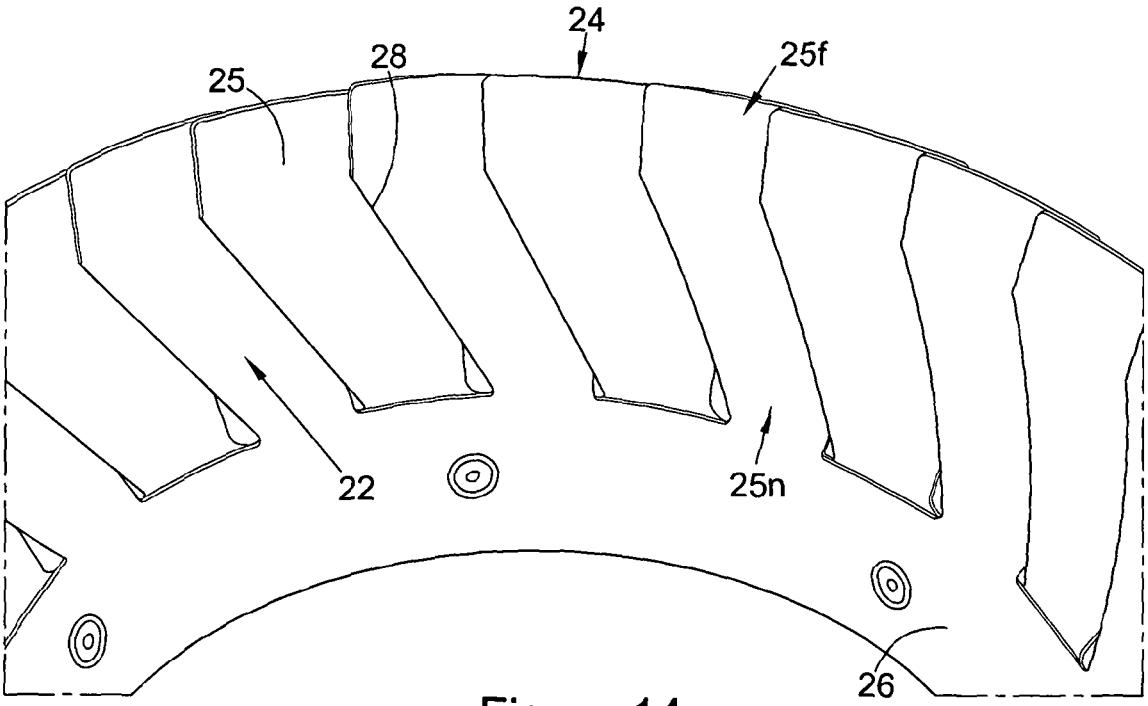
FIG. 14 is a detailed perspective view of part of the flow restrictor of FIG. 13.
Figure 15:
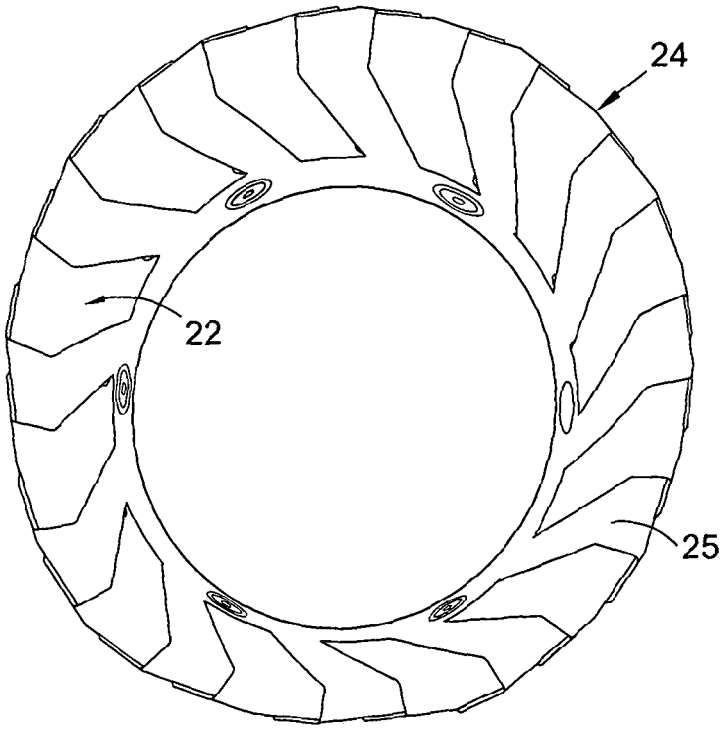
FIG. 15 is an overhead view from along the intermeshed petals of FIG. 13.
Figure 16:
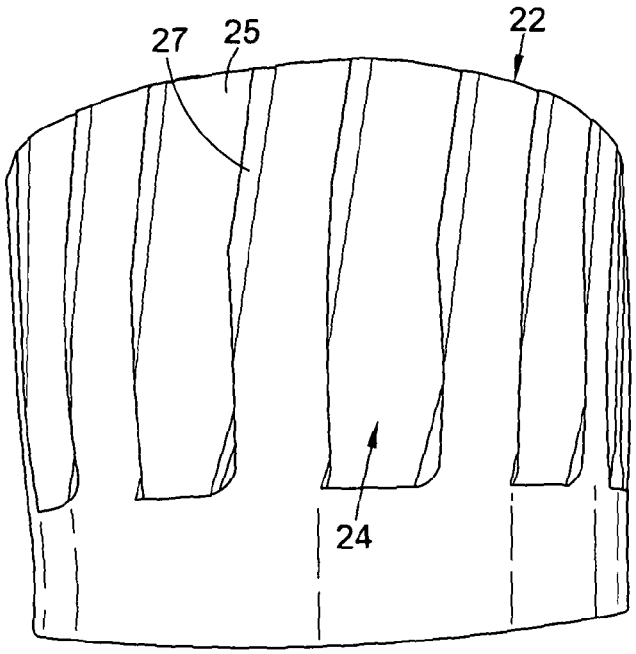
FIG. 16 is a side view of the intermeshed petals of FIG. 13.

When subject to flow through the annulus 104 in the direction of an arrow 110 above the threshold rate, the collar 111 and the elastomeric material 113 radially splay within the annulus 104 to substantially seal the annulus 104 as shown on FIG. 12.

It should be appreciated that the flow restrictor of the invention can be moved to the set configuration to function as a packer, a flow diverter or a piston actuator.

According to all embodiments, once the flow restrictor of the present invention is in the set configuration, the swabbing assembly 60 substantially obturates an annulus and is capable of holding pressure. This can form a seal in the annulus or allow a permissible leak rate that is generally considered acceptable depending on the specific use of the flow restrictor (whether acting as an annular seal, a flow diverter or a downhole actuator) and the general conditions under which it operates.

Figure 17:
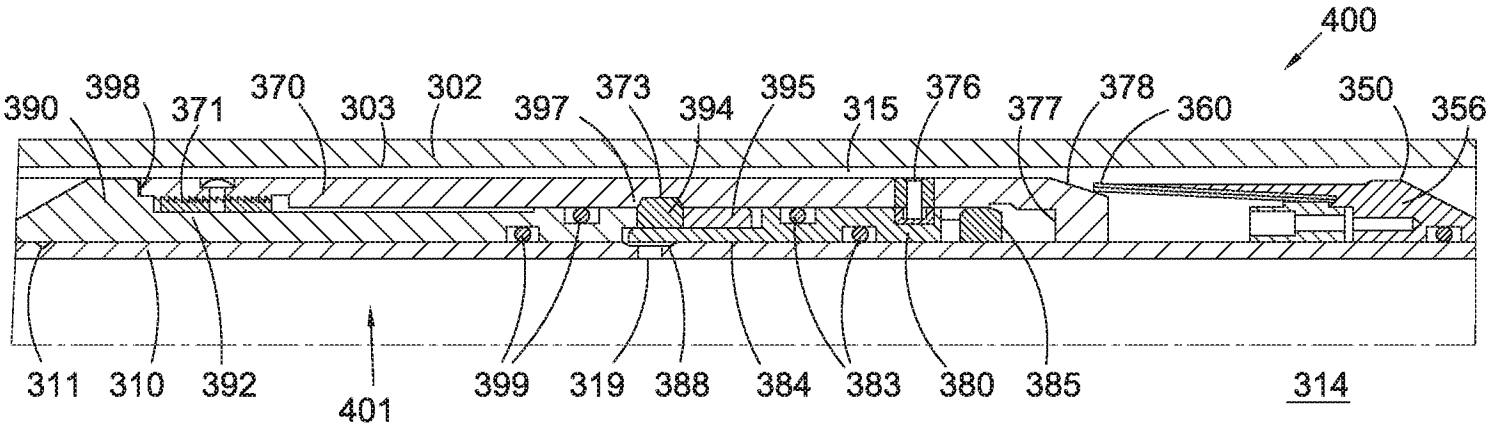
FIG. 17 is a sectional view of another embodiment of the flow restrictor in a run-in configuration.
Figure 18:
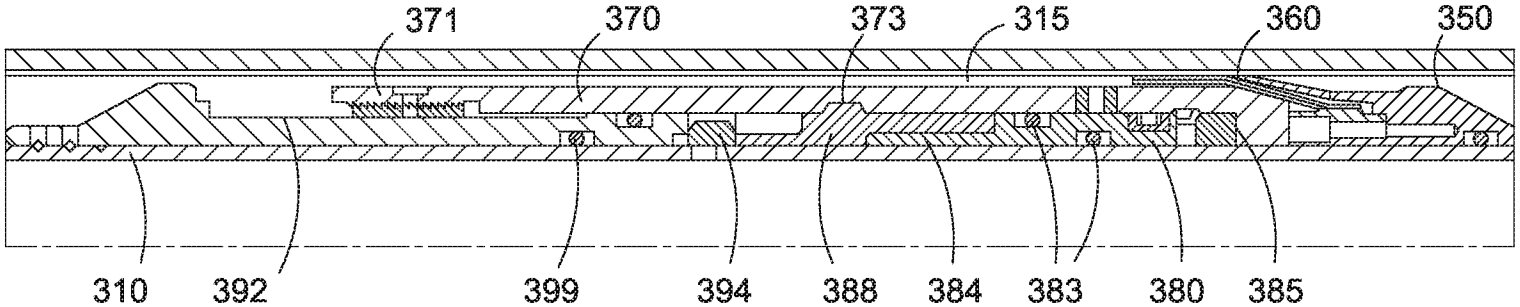
FIG. 18 is a sectional view of the flow restrictor of the fourth aspect of the invention in FIG. 17 in a set configuration.

FIGS. 17 and 18 show a packer 400 having interweaved elongate elements according to the fourth aspect of the invention that is set using a mechanical setting mechanism, shown generally at 401. The setting mechanism 401 comprises a housing 390, a setting sleeve 370, an interlock 394 and a piston 380.

The packer 400 comprises an inner mandrel 310 that defines a throughbore 314.

The inner mandrel 310 has a series of radially spaced ports 319 extending through the sidewall. A swabbing assembly 360 and seal backup 350 are manufactured and arranged in a similar manner as the swabbing assembly 60 and seal backup 50 of the first embodiment. However, the swabbing assembly 360 does not include the rubber layer 40. The seal backup 350 has a thicker collar 356 to space the underside of the swabbing assembly 360 from the inner mandrel 310.

The collar 356 of the seal backup 350 is threadedly engaged to an outer surface of the inner mandrel 310. At the opposing end of the packer 400, the housing 390 is secured by threaded connection 311 to the inner mandrel 310.

The housing 390 is substantially cylindrical and is provided with a reduced diameter portion 395 at its leading end. The reduced diameter portion 395 has a series of radially spaced slots 397 extending therethrough. A toothed profile 392 is formed in a central region of an outer surface of the housing 390. An inner surface of the housing 390 is sealed against the inner mandrel 310 and an outer surface of the housing 390 is sealed against a setting sleeve 370 using a pair of annular seals 399 located in annular grooves.

One end of the setting sleeve 370 is attached to a body lock ring 371 having a profile which engages the toothed profile 392 of the housing to form a ratchet type mechanism. At its opposing end, a frustoconical shaped surface 378 is formed on the outer surface of the setting sleeve 370. A notch 373 shaped to receive the interlock 394 is located on an inner surface of the setting sleeve 370 in a central region. A plurality of radially spaced shear screws 376 attach the setting sleeve 370 to the piston 380.

The piston 380 is sealed in the recess created between the setting sleeve 370 and the inner mandrel 310 by means of annular seals 383 located in annular grooves. The piston 380 has a reduced diameter portion 384 at its trailing end.

The mechanical setting mechanism 401 has an initial run-in configuration as shown in FIG. 17. A trailing end of the setting sleeve 370 abuts an outward shoulder 398 of the housing 390. In this position, the interlock 394 is held in the notch 373 of the setting sleeve 390 by the reduced diameter portion 384 of the piston 380. The piston is held against movement by shear screws 376 extending through the setting sleeve 370. A small part of the frustoconical outer surface 378 of the setting sleeve rests beneath the swabbing assembly 360. In this configuration the port 319 is located between the housing seals 399 and the piston seals 383.

The packer 400 is intended for use in cased hole to substantially 'pack off' (or obturate) an annulus 315 downhole in a high temperature application. Elastomer and other polymer layers are omitted from the swabbing assembly design as required where the temperature of the application exceeds the temperature at which the material properties substantially deteriorate. Thus, the packer 400 is suitable for use in high-temperature wells and wells where steam is present. The packer 400 has a relatively small gauge (outer diameter), but the intermeshed petals 25 allow a significant degree of radial expansion. The packer 400 can be manufactured using a similar process as described with reference to the first embodiment of the invention and therefore provides a low cost reliable packer 400 for any of the following applications: cased hole; high temperature; and high expansion.

According to the present embodiment, the anticipated downhole temperatures can reach 500 F (260° C.) and therefore the rubber layer is not included in the swabbing assembly 360. The packer 400 is made up as part of a tubing string (not shown) and run into a hole lined with casing 302 having an inner diameter 303. The packer 400 is positioned within the casing 302 at the location at which it is desired to seal the annulus.

The throughbore 314 is pressured up to a pressure greater than the rating of the shear screws 376. Pressure is communicated to a piston chamber 388 within the mechanical setting mechanism 401 via the ports 319. When the pressure within the chamber 388 exceeds the pressure rating of the shear screws 376, the screws 376 shear and the piston 380 is no longer retained and is slidably urged towards the swabbing assembly 360 by the pressure differential across the seals 383. The setting sleeve 370 remains locked in the run-in position by the interlock 394. After a predetermined amount of axial travel of the piston 380, the reduced diameter portion 384 is no longer aligned with the interlock 394 and the interlock 394 is no longer urged into the notch 373. As the interlock 394 is released from the notch 373, the setting sleeve 370 is simultaneously released.

The piston 380 travels in the direction of the swabbing assembly 360 until the leading end 385 of the piston 380 contacts an internal shoulder 377 of the setting sleeve 370. Fluid pressure within the throughbore 314 translated to the piston 380 via the ports 319 continues to drive the piston 380, which in turn acts on and axially drives the setting sleeve beneath the swabbing assembly 360. The frustoconical outer surface 378 urges the swabbing assembly radially outwardly and the intermeshed petals 25 splay into an annulus 315 defined between the exterior of the mechanical setting mechanism 401 and the inner diameter 303 of the casing 302. As shown in FIG. 18, the petals 25 deform and splay against the inner diameter 303 of the casing 302 making a metal-to-metal seal. The intermeshing of petals 25 ensure an even deformation and substantially uniform splay as each petal drags adjacent petals radially outwardly. The seal backup 350 is also deformed to support the petals 25. In this way the annulus 315 is packed off.

Axial travel of the setting sleeve 370 with respect to the housing 390 is permitted in the direction of the swabbing assembly 360 but restricted in the opposing direction by the body lock ring 371. The body lock ring 371 has jagged teeth that interact with the toothed profile 392 on the housing 390 to allow relative axial movement in one direction but restrict axial travel in the reverse direction. Thus, the body lock ring 371 remains in position to mechanically support the swabbing assembly 360 once the mechanical setting mechanism 401 has set the packer 400.

Once the packer is set, there may be some leak rate due to the removal of the rubber layer from the swabbing assembly 360. However, for each specific application an operator can determine the level of acceptable leak rate relative to the degradation of elastomer at high temperature and substitution of additional sealing layers of more temperature tolerant materials.

All embodiments of the invention are suitable for use in open holes as well as cased holes. Flow restrictors described herein can be used to restrict flow in an annulus in conjunction with other downhole tools. Downhole completions could be configured with a flow restrictor of the invention located proximate a circulation sleeve. Examples of circulation sleeves for use in conjunction with the flow restrictor include: hydraulically operated sleeves, monobore (shifting tool operable) sleeves, single actuation (one-time ball drop) circulation sleeves, multi-shift sleeve (closable ball drop sleeve), multi-array (ball-drop) stimulation sleeve, one-ball unlimited (I-Ball™) sleeves, and RFID tag operated sleeves (Autostim™).

Modifications and improvements can be made without departing from the general scope of the invention.

The invention claimed is:

1. A flow restrictor for restricting flow in an annulus, the flow restrictor comprising:

a body; and a restrictor assembly mounted on the body, wherein the flow restrictor is actuable by fluid flow over the restrictor assembly above a threshold flow rate actuating the restrictor assembly from a run-in configuration to a set configuration, wherein the restrictor assembly has a fixed portion that remains fixed relative to the body and a movable portion that is movable from a stowed position in the run-in configuration to a radially splayed position in the set configuration to thereby substantially restrict flow in the annulus, wherein said movable portion moves from said stowed position to said radially splayed position by pivoting relative to the fixed portion in response to the fluid flow across the restrictor assembly in a direction from the movable portion towards the fixed portion, and wherein the flow restrictor has a central axis and at least a part of the restrictor assembly is inclined at an angle of incline relative to the central axis, the body being tapered to define the angle of incline of the at least part of the restrictor assembly.

2. The flow restrictor according to claim 1, wherein a part of the restrictor assembly is deformable above the threshold flow rate to move the restrictor assembly from the run-in configuration to the set configuration.

3. The flow restrictor according to claim 1, wherein the restrictor assembly is a frustoconical shape.

4. The flow restrictor according to claim 1, wherein the angle of incline of the restrictor assembly is between one and seven degrees relative to the central axis.

5. The flow restrictor according to claim 1, wherein the restrictor assembly comprises at least one layer of deformable material.

6. The flow restrictor according to claim 1, comprising a backup mechanism to retain the restrictor assembly in the set configuration.

7. The flow restrictor according to claim 1, wherein at least one of:

the flow restrictor is arranged to act as an annular seal in the set configuration;

the flow restrictor is arranged to act as a fluid flow diverter within the annulus;

the flow restrictor is arranged to act as an actuator;

the flow restrictor is mounted on a tubular proximate a tool such that the flow restrictor is slidable along the tubular when a predetermined flow rate acts against the flow restrictor in the set configuration to thereby act as an annular piston and actuate the tool;

the flow restrictor is a packer.

8. A method of restricting flow in an annulus, the method comprising the steps of:

providing a flow restrictor according to claim 1;

running the flow restrictor into a hole in the run-in configuration;

pumping fluid into the hole above the threshold flow rate;

flow actuating the flow restrictor from the run-in configuration to the set configuration in which the at least a portion of the restrictor assembly is radially splayed, by flowing the fluid over the restrictor assembly above the threshold flow rate.

9. The method according to claim 8, including fixing a portion of the restrictor assembly relative to the body and providing a movable portion of the restrictor assembly and flowing fluid over the restrictor assembly in direction from the movable portion towards the fixed portion, thereby substantially restricting flow in the annulus.

10. The method according to claim 8, including at least one of:

pumping fluid above the threshold flow rate into an annulus between the hole and a tubing; and pumping fluid above the threshold flow rate into an annulus by pumping fluid through tubing having a port opening into the annulus.

11. The method according to claim 8, including moving the flow restrictor from the run-in configuration to the set configuration by deforming the restrictor assembly in response to fluid flow above the threshold flow rate.

12. The method according to claim 8, including providing a plurality of metal petals in the restrictor assembly and deforming the petals by flowing fluid over the restrictor assembly above the threshold value.

13. The method according to claim 8, including selecting the value of threshold flow rate such that it exceeds flow rates to which the flow restrictor is exposed during running the flow restrictor into the hole.

14. The method according to claim 8, including providing a backup mechanism to substantially restrict further deformation of the flow restrictor once the flow restrictor is in the set configuration and activating the backup mechanism by moving the restrictor assembly from the run-in to the set configuration.

15. The method according to claim 8, including sealingly engaging the hole when the flow restrictor is in the set configuration.

16. The method according to claim 8, including maintaining a pressure differential within the annulus when the flow restrictor is in the set configuration.

17. The method of stimulating a geological formation including the steps of:

opening a port in a tubing;

restricting flow in an annulus according to claim 8, including pumping stimulating fluid above the threshold flow rate; and stimulating the geological formation using the flow restrictor in the set configuration to substantially obturate the annulus and direct the flow of stimulating fluid into the geological formation.

18. A flow restrictor for restricting flow in an annulus, the flow restrictor comprising:

a body; and a restrictor assembly mounted to the body, wherein the flow restrictor is actuable by fluid flow over the restrictor assembly above a threshold flow rate actuating the restrictor assembly from a run-in configuration to a set configuration, wherein the restrictor assembly has a fixed portion that remains fixed relative to the body and a movable portion that is movable relative to the fixed portion from a stowed position in the run-in configuration to a radially splayed position in the set configuration to thereby substantially restrict flow in the annulus, wherein said movable portion moves from said stowed position to said radially splayed position by pivoting relative to the fixed portion in response to the fluid flow across the restrictor assembly in a direction from the movable portion towards the fixed portion, and wherein the restrictor assembly has at least two layers of interweaved elongate elements deformable to move between the run-in and set configurations, the elongate elements from a first layer of the at least two layers of interweaved elongate elements being alternately interweaved with elongate elements from a second layer of the at least two layers of interweaved elongate elements, a leading edge of each elongate element overlaying a trailing edge of an adjacent elongate element on one side, and a trailing edge of each elongate element overlaid by a leading edge of an adjacent elongate element on the other side.

19. The flow restrictor according to claim 18, wherein the at least two layers of elongate elements are interweaved such that radial splay of one elongate element acts on the adjacent elongate elements to urge radial splay of adjacent elongate elements.

20. The flow restrictor according to claim 18, wherein at least one of:

the elongate elements are metal elongate elements; and the elongate elements comprise petals extending outwardly from a collar.

21. The flow restrictor according to claim 18, whereby deformation of elongate elements is actuable by at least one of:

fluid flow above a threshold flow rate; and a mechanical mechanism.

22. The flow restrictor according to claim 5, wherein at least one of:

the restrictor assembly comprises a plurality of layers of the deformable material;

at least one of layer of the deformable material is metal;

at least one layer of the deformable material has a plurality of petals arranged to radially splay when exposed to the fluid flow rates above the threshold flow rate value;

the restrictor assembly has at least two interweaved deformable layers of metal; and the restrictor assembly comprises a plurality of deformable sealing layers.

23. The flow restrictor according to claim 6, wherein at least one of:

the backup mechanism is arranged such that movement of the restrictor assembly to the set configuration actuates the backup mechanism; and the backup mechanism supports at least a portion of the length of the restrictor assembly and restricts further movement of the restrictor assembly in the direction of fluid flow once the flow restrictor is in the set configuration.

24. The flow restrictor according to claim 18, wherein the restrictor assembly is a frustoconical shape.

25. The flow restrictor according to claim 18, wherein the flow restrictor has a central axis and at least a part of the restrictor assembly is inclined at an angle relative to the central axis.

26. The flow restrictor according to claim 18, wherein the restrictor assembly comprises at least one layer of deformable material.

27. The flow restrictor according to claim 26, wherein the restrictor assembly comprises a plurality of layers of the deformable material.

28. The flow restrictor according to claim 27, wherein the restrictor assembly comprises a plurality of deformable sealing layers.

29. A method of restricting flow in an annulus, the method comprising the steps of:

providing a flow restrictor according to claim 18; and flow actuating the restrictor assembly between the run in configuration and the set configuration by: flowing fluid over the restrictor assembly above a threshold flow rate, and deforming the interweaved elongate elements to the set configuration in which the at least a portion of the restrictor assembly is splayed to thereby substantially restrict flow in the annulus.

30. The method according to claim 29, comprising deforming the elongate elements using a mechanical mechanism.

31. The method according to claim 29, comprising deforming the elongate elements by fluid flow above a threshold value selected to exceed the flow rates to which the flow restrictor is exposed while the flow restrictor is run in to a bore.

32. The method according to claim 31, wherein the elongate elements comprise petals extending outwardly from a collar, and the method comprises selecting the length and thickness of the petals according to the threshold flow rate.

33. The flow restrictor according to claim 1, wherein the flow restrictor is actuable by the fluid flow over at least a portion of an outer surface of the restrictor assembly above the threshold flow rate.

34. The method according to claim 8, wherein flow actuating the flow restrictor comprises flowing fluid over at least a portion of an outer surface of the restrictor assembly above the threshold flow rate.

* * * * *